US007210848B2

(12) United States Patent
Barbier et al.

(10) Patent No.: US 7,210,848 B2
(45) Date of Patent: May 1, 2007

(54) SYSTEM FOR OPENING/CLOSING A PACKAGING BAG, AND PACKAGING BAG EQUIPPED WITH THIS SYSTEM

(75) Inventors: Eric Barbier, Marcy sur Anse (FR); Jean-Pierre Barbier, Ternand (FR)

(73) Assignee: Morance Soudure, Villafranche sur Saone (FR)

( * ) Notice: Subject to any disclaimer, the term of this patent is extended or adjusted under 35 U.S.C. 154(b) by 545 days.

(21) Appl. No.: 10/737,907

(22) Filed: Dec. 18, 2003

(65) Prior Publication Data

US 2005/0135712 A1 Jun. 23, 2005

(51) Int. Cl.
*B65D 33/16* (2006.01)
*B65D 33/10* (2006.01)

(52) U.S. Cl. ..... 383/66; 383/10; 383/78

(58) Field of Classification Search ..... 383/64, 383/69, 78, 10, 66; 24/415, 437, 399–400
See application file for complete search history.

(56) References Cited

U.S. PATENT DOCUMENTS

| | | | | | |
|---|---|---|---|---|---|
| 791,332 | A * | 5/1905 | Duval | ..... | 24/437 |
| 1,071,991 | A * | 9/1913 | Ebert | ..... | 383/69 |
| 1,220,602 | A * | 3/1917 | Campbell et al. | ..... | 24/437 |
| 1,371,934 | A * | 3/1921 | Reynolds | ..... | 383/33 |
| 1,734,479 | A * | 11/1929 | Glidden | ..... | 24/437 |
| 2,445,650 | A * | 7/1948 | Walker | ..... | 383/66 |
| 6,059,456 | A * | 5/2000 | May | ..... | 383/63 |
| 6,074,094 | A * | 6/2000 | Manolizi et al. | ..... | 383/5 |
| 6,177,172 | B1 * | 1/2001 | Yeager | ..... | 428/101 |
| 6,652,436 | B1 * | 11/2003 | Yeager et al. | ..... | 493/213 |
| 7,040,810 | B2 * | 5/2006 | Steele | ..... | 383/66 |

* cited by examiner

*Primary Examiner*—Jes F. Pascua
(74) *Attorney, Agent, or Firm*—Oliff & Berridge, PLC

(57) ABSTRACT

System for opening/closing a packaging bag, comprising an opening formed in one of its walls, delimited by edges of this wall.

Furthermore, this system comprises a flat base piece at least partially delimiting an opening through it and comprising the two longitudinal elements intended to be connected to the bag, this base piece thus being able to accommodate the slider and being intended to be fixed to the wall of the bag in such a way that the opening that it delimits coincides with the opening made in the wall of the bag.

14 Claims, 4 Drawing Sheets

SYSTEM FOR OPENING/CLOSING A PACKAGING BAG, AND PACKAGING BAG EQUIPPED WITH THIS SYSTEM

The present invention relates to a system for opening/closing a packaging bag and to a packaging bag equipped with this opening/closing system.

This bag is intended in particular for packaging relatively heavy products, in granular or powder form. The bag according to the invention finds a particularly useful application in packaging food products for animals, of the dry food or pasta type, food products sold wholesale, for example coffee, gardening products such as peat, manure or seeds, and building products such as cement or lime, or the like.

The packaging of relatively heavy products in granular or powder form is currently done using paper bags comprising two bow-shaped carry handles at their upper ends. These handles are made of strips of reinforced paper and are attached to the walls of the bag.

The upper part of such bags is closed by bonding or stitching.

These bags have the major disadvantage of not being very easy to open and that they have to be somewhat torn in order to allow them to be opened, making the tipping out of the products rather haphazard and prone to spillage.

There exists a system for opening/closing a packaging bag that comprises a profiled longitudinal element that can nest together in another profiled longitudinal element that has a complementary shape.

This system is not entirely satisfactory. This is because it is not very easy to handle and does not seal well. In addition, it has the disadvantage of becoming soiled when the product contained in the bag generates dust, as is the case with animal feed in the form of dry food. Furthermore, the assembly of the said longitudinal elements may not be strong enough to allow the use of the system on packaging bags containing relatively heavy products.

The existing bags also have the disadvantage of not being very practical to handle in the case of upending them so as to tip out the product they contain, and the shaping of the openings of these bags is not always well suited to a controlled pouring out of the product.

Existing paper bags also have the disadvantage of mediocre sealing, posing problems of smells at the sales points in the case of certain products, particularly animal feed products of the dry food type, or problems of fluidic exchange generally through the walls of the bag in the time it takes to sell the products, this in particular consisting in the product absorbing moisture or drying out.

The walls of these bags may also not be perfectly assembled at the folds that form the bottoms or tops of the bags, and it sometimes happens that openings remain at these folds, allowing insects such as cockroaches to enter the bags.

The present invention aims to remedy all of these significant drawbacks.

The main objective of the invention is to supply an opening/closing system that is easy to handle, allows opening that it easy and quick to achieve, that seals well, that does not become soiled when the product contained in the bag generates dust, and is strong enough that it can be used on packaging bags containing relatively heavy products.

Other objectives of the invention are to appreciably improve the handling of the bag when upending it with a view to tipping the product out, and of providing perfect control over this tipping out.

Another objective of the invention is to provide a bag that has perfect sealing particularly against odours and moisture.

An additional objective is to provide a bag which, by comparison with the bags according to the prior art, has an improved visual appearance, particularly having a lesser tendency to crumpling and having a smooth and shiny appearance.

According to the invention, the opening/closing system comprises:

- two longitudinal elements, each one forming a means for guiding a sliding movement, one of these longitudinal elements being intended to be connected, directly or otherwise, to one of the edges of the bag delimiting the opening that this bag has and the other of these longitudinal elements being intended to be connected, directly or otherwise, to the other of the edges of the bag delimiting this opening;
- a slider comprising:
  - (i) two longitudinal elements, each forming a means for guiding a sliding movement, one of these longitudinal elements being intended to engage with one of the said longitudinal elements intended to be connected to the bag and being able to slide with respect thereto, and the other of these longitudinal elements being intended to engage with one of the said longitudinal elements intended to be connected to the bag and able to slide with respect thereto;
  - (ii) a central wall connecting the two longitudinal elements of the slider to one another.

According to the essential feature of the invention, the system comprises a flat base piece at least partially delimiting an opening through it and comprising the two longitudinal elements intended to be connected to the bag, this base piece thus being able to accommodate the slider and being intended to be fixed to the wall of the bag so that the opening that it delimits coincides with the opening made in the wall of the bag.

This base piece makes it possible, not only to assemble the system with the wall of the bag, but also to stiffen the regions of the bag bordering the opening made in the wall of the bag, so as to assist the movement of the slider.

This central wall of the slider thus covers the opening of the bag when the said longitudinal elements intended to be connected to the bag are connected to the wall of the bag and when the said longitudinal elements of the slider engage with these longitudinal elements intended to be connected to the bag.

The opening or closing of the bag is performed simply by moving the slider along with respect to the wall of the bag.

The opening/closing system according to the invention thus entails no assembly on the part of the consumer of one longitudinal element with another, but simply entails moving the slider along with respect to the longitudinal elements intended to be connected to the bag.

This opening/closing system is easy to handle and allows quick and easy opening of the bag. It does not become soiled when fitted to a bag containing a product which generates dust, as this dust is extracted from the guide means that the said longitudinal elements form each time the slider is moved.

In the closed position, the slider fully covers the opening of the bag, which it is able to close with a good seal.

Furthermore, the two pairs of longitudinal elements give the system according to the invention strength that allows this system to be used on packagings containing relatively heavy products.

Advantageously, the slider comprises at least one tab intended to be grasped by the user in order to move the slider. It may in particular comprise a tab at each end allowing it to be moved by pulling on the tabs in the direction for opening, then in the direction for closing the bag.

As a preference, the said longitudinal elements intended to be connected to the bag and the said longitudinal elements of the slider are shaped so that they can be brought into engagement by clipping them together, making it very much easier to manufacture and assemble the system.

Advantageously, the said longitudinal elements intended to be connected to the bag, the said slider and/or the said longitudinal elements of the slider comprise means forming limit stops limiting the movement of the slider in the direction for opening the bag.

This limit stop makes it possible to eliminate the risk of the longitudinal elements of the slider disengaging from the longitudinal elements intended to be connected to the bag.

These same longitudinal elements intended to be connected to the bag, this slider and/or the longitudinal elements of the slider may also comprise means forming limit stops limiting the movement of the slider in the direction for closing the bag, making it possible to clearly define the closed position of the slider.

This clear definition of the closed position of the slider greatly reduces the risk of incorrect use of the system.

Advantageously, the slider comprises a tab for grasping which is connected to it by a connecting portion and extends on one side of the said base piece, while the said tab for grasping extends on the other side of the base piece, the said connecting portion thus being engaged through the opening that the base piece delimits.

The latter may thus be fixed against the internal face of the wall of the bag, allowing it to be concealed and allowing the slider it comprises to be concealed. In addition, only the tab for grasping protrudes to the outside of the bag, this having the advantage of making the handling of the system obvious to the consumer, that is to say making it obvious that this tab for grasping needs to be grasped in order to move the slider.

As a preference, the base piece delimits the entirety of the opening that it comprises,.particularly the ends of this opening, and the regions of this base piece which delimit these ends of the opening, and the said connecting portion, are sized to form the said limit stops that limit the movement of the slider.

Advantageously, each of the said regions of the base piece delimiting one end of the said opening forms a flap projecting towards the inside of this opening.

The flaps thus formed are covered by the said connecting portion in the closed position, ensuring that the opening/closing system according to the invention seals perfectly.

These flaps preferably have a roughly semicircular shape.

The bag according to the invention is, for its part, equipped with the opening/closing system as mentioned above.

Preferably, this bag comprises:

- two walls joined together at their upper parts, along a joining line, one of which comprises the said opening along this joining line, and near to the latter, and
- a handle formed at these upper parts, in the central region of the said joining line.

Pulling the handle with a view to lifting the bag raises the central region of the said joining line with respect to the end regions thereof, and this tends to bring the two extreme regions closer together. This movement closer together tends to give the bag a concave curvature over the said opening and, accordingly, a convex curvature to the bag under this opening. This simple lifting effort thus tends to form a spout through which the product can be poured.

Handling the bag with a view to upending it in order to tip the product out is particularly simple to perform because all that is required, once the said cut has been made, is for the said handle to be grasped with one hand in order to lift the bag, for the bottom of the bag to be grasped with the other hand, and for this bottom to be lifted up until the product slides out through the spout.

Advantageously, the walls of the bag which are connected to one another extend above the said joining line so as to form a double-walled strip, and this strip comprises openings for forming the said handle.

This handle is thus produced in a simple, easy and inexpensive way and is particularly robust, thus affording complete safety as regards the strength of this handle while the bag is being carried around.

As a preference, the walls of the bag are made of a synthetic material that can be welded.

This weldability makes it possible to obtain a perfect seal, eliminating the problems of diffusion of odours and fluidic exchanges between the inside and the outside of the bag, or the ingress of insects into the bag.

Furthermore, the use of such a material makes it possible to obtain a bag that has an improved visual appearance resulting in particular from a reduced tendency to crumple and a shiny and smooth appearance.

This material may be formed by what is known as "bubble extrusion" with a polyethylene-EVOH-polyamide-polypropylene structure, and any type of medium-,low-or high-density polyethylene and may be complexed onto aluminium, polypropylene, polyester, aluminized polyester, paper, etc.

This material proves to be, as a result of its structure, completely impermeable with respect to fluidic transfers between the inside and the outside of the bag.

The problems of the diffusion of odours and of the absorption of moisture or the drying out of the product during the time for which the bags are on display for sale are thus eliminated.

Advantageously, a film for a packaging a bag according to the invention comprises at least one opening/closing system.

According to one possibility, a film for a packaging bag is equipped with several opening/closing systems and is packaged in the form of a roll.

This arrangement makes it possible to simplify the manufacture of the bags by dividing it into a step of attaching the opening systems and a step of forming the bag.

For a correct understanding thereof, the invention is described once again hereinbelow with reference to the attached schematic drawing, which, by way of nonlimiting example, depicts one preferred embodiment of the packaging bag to which it relates.

FIGS. 1 to 11 depict a packaging bag 1 particularly intended for packaging a relatively heavy product, in granular or powder form, such as dry food for feeding animals.

Figure 1:
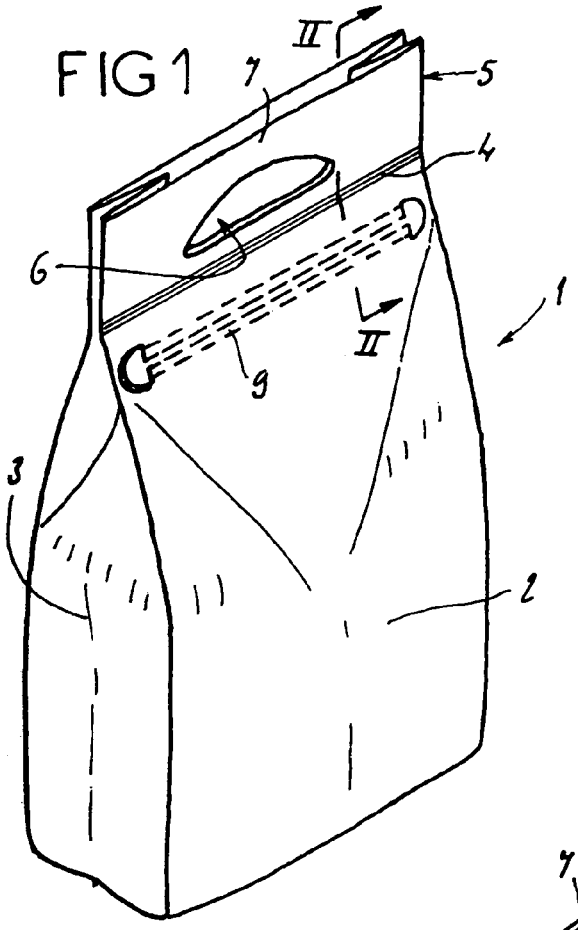
FIG. 1 is a perspective view thereof.

The bag 1 has two main walls 2 and two side walls 3 of smaller dimensions.

These walls 2, 3 are made of a material that can be welded by heat sealing.

The main walls 2 are joined together at their upper parts, by heat sealing along a joining line 4, and each wall 3 is connected by heat sealing to the adjacent wall 2, along joining lines that continue the line 4.

The walls 2 are continued above the line 4 to form a double-walled strip 5 in the middle part of the bag 1.

The walls 2, 3 comprise two openings 6 formed in the middle region of the strip 5, making it possible to form a carry handle 7 used also for handling the bag 1.

Two pieces of material may be attached to the internal face of the walls 2 at these openings 6 to reinforce these walls at these openings.

Figure 2:
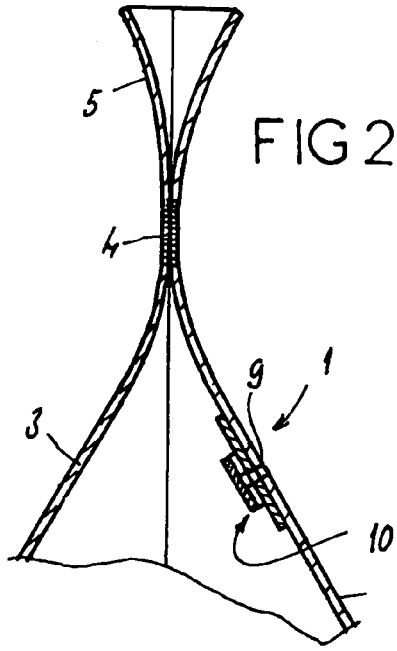
FIG. 2 is a part view, on a larger scale, in section on II—II of FIG. 1.

The wall 2 has a precut for delimiting a strip 9 under and along the line 4, and has a closing system 10 fixed on its internal face under this strip 9, as shown by FIG. 2.

The strip 9 has rounded ends which are cut and which can thus be lifted up and grasped to allow this strip 9 to be removed by pulling it by hand.

Figure 4:
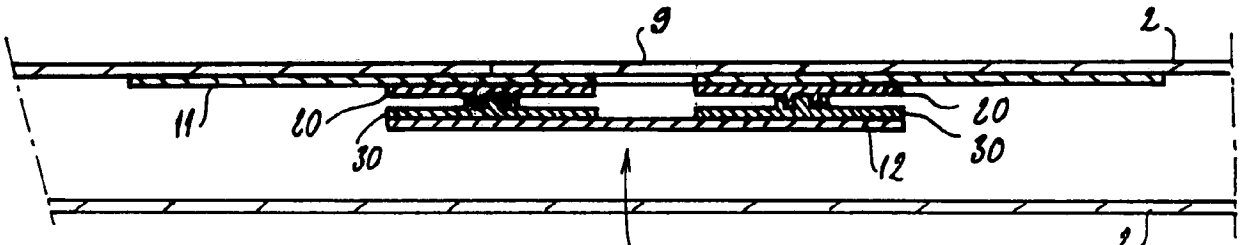
FIG. 4 is a view in cross section of the opening/closing system it comprises.
Figure 5:
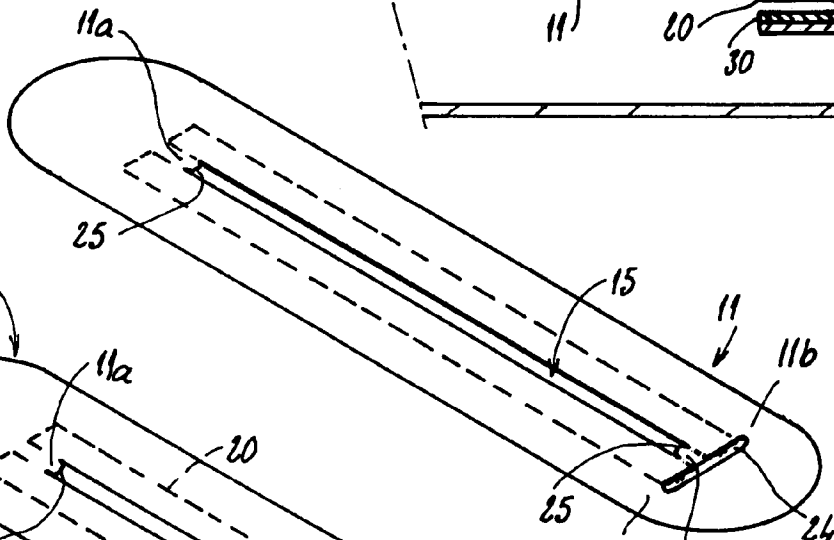
FIG. 5 is a perspective view of two parts that make up the system, prior to assembly.
Figure 6:
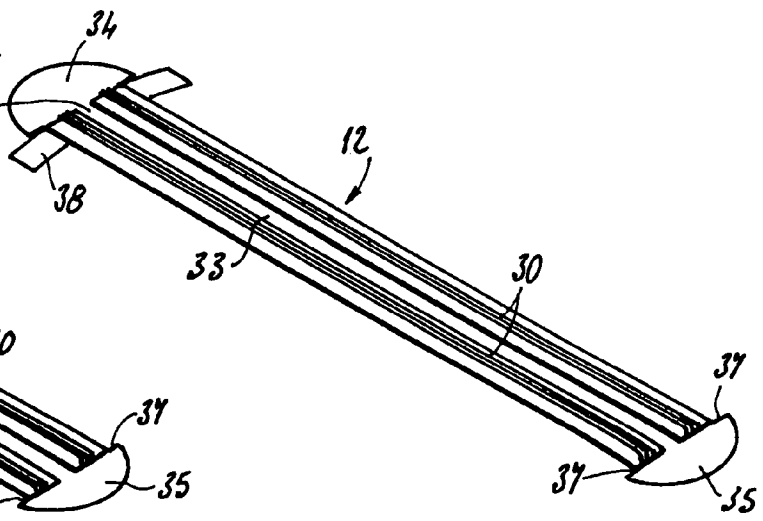
FIG. 6 is a view of the opening/closing system which is similar to FIG. 5, after the said parts have been assembled.
Figure 6:
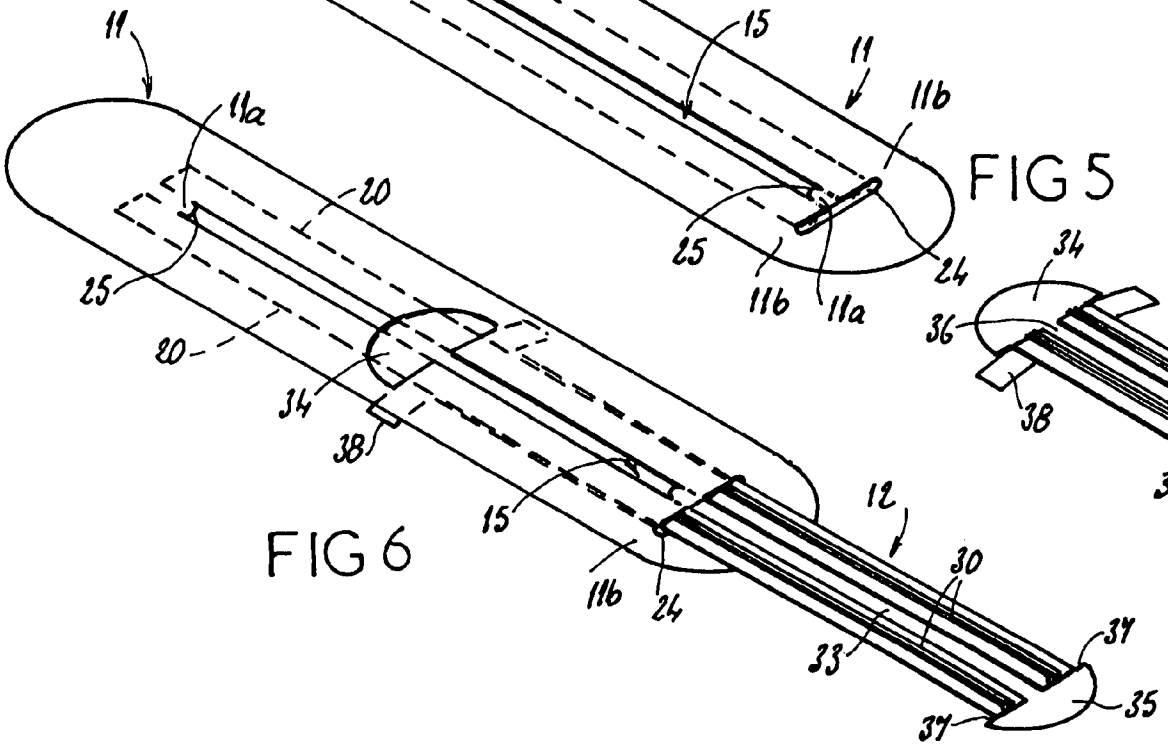

As shown more particularly in FIGS. 4 to 6, the closing system 10 comprises a base piece 11 and a slider 12.

The base piece 11 is made of a synthetic material able to be fixed to the wall 2 particularly by welding by thermal bonding. It has an elongate shape and rounded ends and delimits a slit-shaped central opening 15.

On one of its faces, it has two profiled longitudinal elements 20 forming slideways which run along the edges of the piece 11 longitudinally delimiting the opening 15 as far as the ends thereof.

Figure 7:
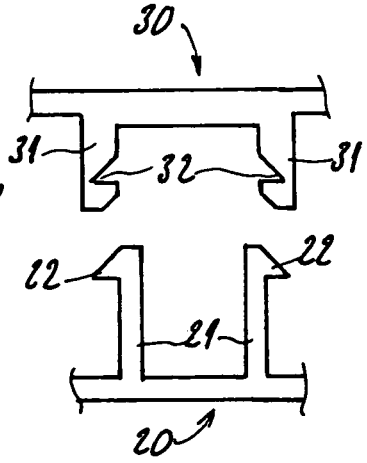
FIGS. 7 to 11 are views in cross section of various possible embodiments of longitudinal elements for guiding and sliding that this system comprises.

Each of these elements 20 may have one of the shapes shown on a larger scale in the lower parts of FIGS. 7 to 11, namely:

- two parallel longitudinal walls 21, provided with exterior ribs 22 as shown in FIG. 7,
- two parallel longitudinal walls 21 provided with internal returns 22 of various shapes, as shown by FIGS. 8 to 11.

In all events, these ribs and returns 22 are shaped to allow a clipping together of elements 30 shown in the upper parts of FIGS. 7 to 11 into the elements 20 shown into the lower parts of FIGS. 7 to 11.

Figure 8:
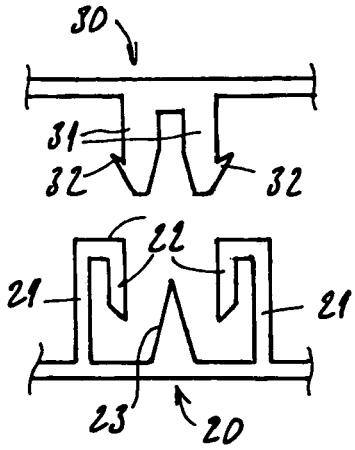
Figure 9:
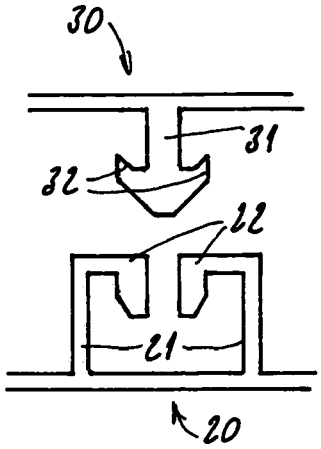
Figure 10:
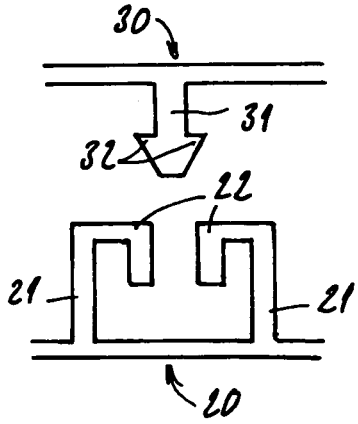
Figure 11:
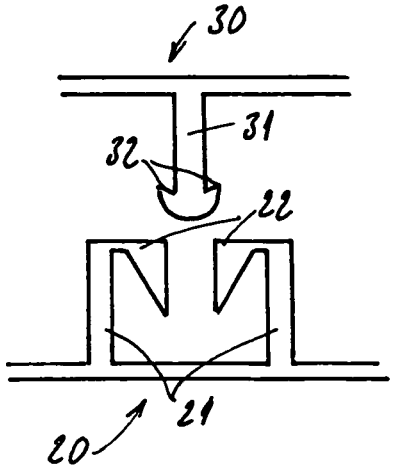

Each of the elements 20 may have a central rib 23 forming an additional sliding surface, as can be seen in FIG. 8.

With reference once again to FIGS. 4 to 6 it can be seen that the base piece 11 has, at one of its ends, a transverse slit 24 dimensioned to accommodate the slider 12 through it, with the possibility of sliding.

Furthermore, the regions 11*a* of the piece 11 which delimit the ends of the opening 15 form semicircular flaps 25.

The slider 12 comprises two profiled longitudinal elements 30, each of which may have one of the shapes shown on an enlarged scale in the upper parts of FIGS. 7 to 11, namely:

- two parallel longitudinal walls 31 exhibiting interior grooves 32 able to engage by clip-fastening over the ribs 22 of the element 20 as shown in FIG. 7, or
- one or two walls 31 with external clip-fastening ribs 32 able to be engaged by clip-fastening over the returns 22 of the elements 20 as shown in FIGS. 8 to 11.

This or these walls 31 may be received against the end wall that the elements 20 form or, as shown in FIG. 8, on the additional sliding rib 23.

Referring once again to FIGS. 4 to 6, it can be seen that the elements 30 run parallel to one another and are shaped and positioned in such a way as to engage by clip-fastening with the elements 20, this clip-fastening allowing the slider 12 to slide with respect to the base piece 11.

The slider 12 has a central wall 33 connecting the elements 30 together and comprises two rounded parts 34, 35 connected to its ends, having a width greater than its own. These-rounded parts 34, 35 form pull tabs that can be grasped by the consumer and make it easier to move the slider 12.

One of these tabs 34 is separated from the slider 12 by two transverse slots which delimit a connecting portion 36 connecting the tab 34 to the slider 12, this connecting portion 36 having a width smaller than the width of the opening 15.

The other tab 15 is contiguous with the slider 12 and forms two transverse edges 37 that can bear against the regions 11*b* of the piece 11 which delimit the opening 24.

The slider 12 further comprises a transverse piece 38 fixed to it near the slots separating the slider 12 from the tab 34. This piece 38 protrudes on each side of the slider 12 and can come to bear against the regions 11*b* of the piece 11.

As can be understood by comparing FIGS. 5, 6 and 4, the slider 12 is intended to be engaged through the slit 24 in such a way that the elements 30 can engage with the elements 20 by the clip-fastening of the ribs or grooves 32 behind the returns or ribs 22.

The tab 34 is engaged through the slit 15 and therefore extends on the opposite side of the piece 11 to the side on which the slider 12 is located, said connecting portion 36 extending through the opening 15.

The portions of the piece 38 protruding on each side of the slider 12 bear against the piece 11.

As can be understood with reference to FIG. 6, the slider 12 can be moved with respect to the piece 11 between a position in which the opening 15 is completely closed off and a position in which this opening 15 is completely uncovered. In the completely closed-off position, the connecting portion 36 bears against the flap 25, thus closing the opening 15 with a good seal, and the edges 37 bear against the said regions 11*b*, thus distinctly limiting the travel of the slider 12. In the position in which the opening 15 is completely uncovered, the portions of the piece 32 protruding on each side of the slider 12 bear against the regions 11*b* of the piece 11, also limiting the travel of the slider 12.

In practice, as can be seen with reference to FIG. 1, the strip 9 is torn off to give access to the system 10 and to free the tab 34 and therefore the slider 12 so that they can be slid.

The tab 35 is grasped by the consumer and moved in the direction for opening the bag 1.

Figure 3:
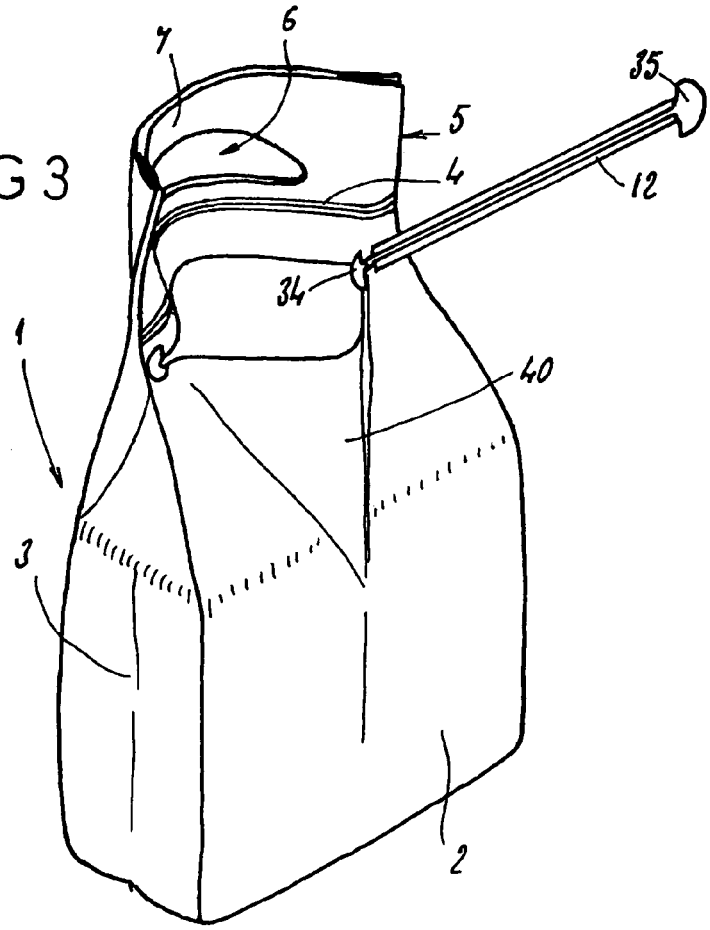
FIG. 3 is a view thereof similar to FIG. 1, after opening, in the configuration it adopts when lifted up by pulling on a carrying handle that it has at its upper part.

The handle 7 is then grasped, causing the middle region of the line 4 to be lifted up with respect to the end regions thereof, and tending to bring these two end regions closer together. This moving closer together tends to give the upper part of the bag 1 a concave curvature and accordingly tends to give a convex curvature to the part of the wall 2 situated under the system 10, as shown in FIG. 3. This lifting also makes it possible to form a spout 40 from which the product can be tipped.

Handling the bag with a view to upending it in order to tip the product out is particularly simple to perform because all that is required is for the said handle 7 to be grasped with one hand to lift the bag up, for the bottom of the bag to be grasped with the other hand and for this bottom to be lifted up until the product slides out through the spout 40.

After tipping, the bag 1 is closed simply by grasping the tab 34 and moving the slider 12 until the opening 15 is closed off.

As is apparent from the foregoing, the invention provides a system for opening/closing a packaging bag that is easy to handle, allows easy quick opening, gives a good seal, does not become soiled when the product contained in the bag generates dust, and is strong enough to be able to be used on packaging bags containing relatively heavy products.

The invention also provides a packaging bag the handling of which is appreciably improved and the sealing of which is perfect, particularly with regard to odours and moisture.

Figure 12:
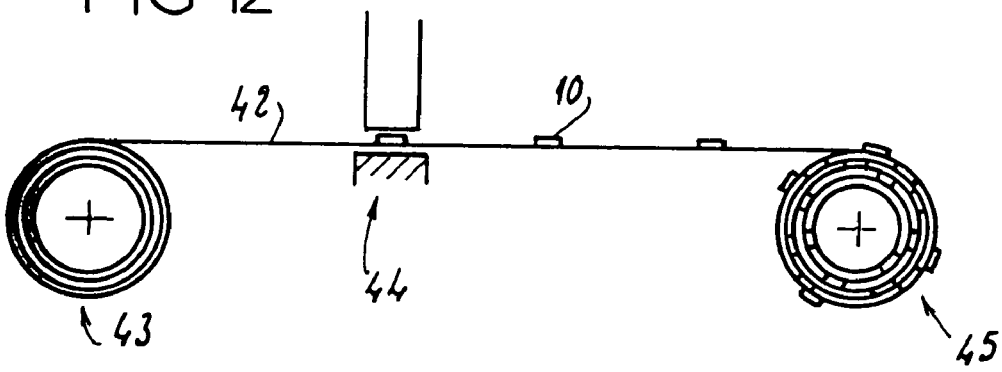
FIG. 12 is a schematic side view of a device for manufacturing rolls of film comprising an opening/closing system.
Figure 13:
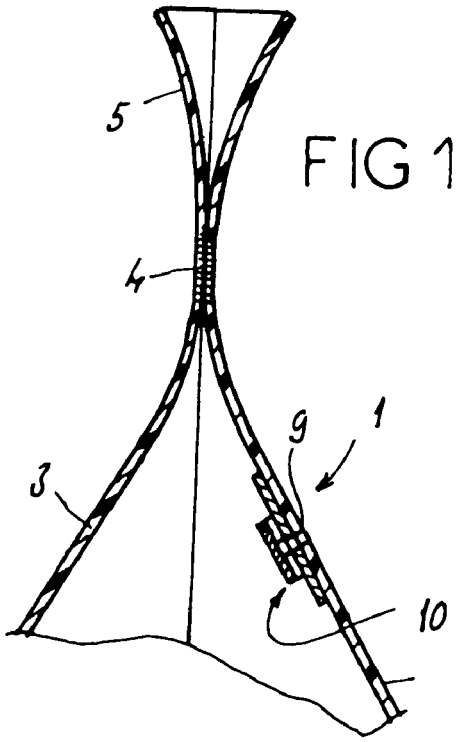
FIG. 13 is a part view of another embodiment, on a larger scale, in section on II—II of FIG. 1, in which the material of the walls of the bag have a polyethylene-EVOH-polyamide-polypropylene structure.

FIG. 12 illustrates a method of manufacture of rolls 4 of film 42 of heat sealable/weldable material constituting the walls of the bag 1, the film being equipped with opening/closing systems 10.

A first roll 43 of the film 42 is paid out step by step in a path parallel to the line of the edges of the film 42 and in a direction indicated by the arrow P. An attachment station 44 for attaching opening/closing systems 10 is situated downstream of the roll 43 in the direction of advance of the film 42. This station allows the attachment of an opening/closing system 10, each time the advance of the film 42 halts, to this film 42 via its base piece 11, particularly by heat sealing.

The opening/closing systems 10 are attached at right angles to the direction of advance of the film 42. The film 42 thus equipped is then wound onto a second roll 43 situated downstream of the attachment station 44. Each opening/closing system. 10 has a length shorter than half the width of the film 42.

Attaching the opening/closing systems 10 to the film prior to the manufacture of the bags 1 makes this manufacture simpler.

Indeed, by using such rolls 44, each bag 1 can be formed simply by paying out from the roll 45, folding the film 42 first of all parallel to the direction of its path to form the walls of the bag 1 and then making connections and cuts at right angles to this direction of travel.

It goes without saying that the invention is not restricted to the embodiment described hereinabove by way of example but that, on the contrary, it encompasses all alternative forms of embodiment thereof. Thus, the bag may be of the type with welded gusset edges, as depicted in the figures, or may be of the type with a square bottom or a bottom gusset, or may alternatively be devoid of gussets.

The invention claimed is:

1. A combination of for opening/closing system a packaging bag comprising an opening formed in a wall of the bag, the opening delimited by edges of the wall, comprising:

two first longitudinal elements, each one forming a means for guiding a sliding movement, one of the first longitudinal elements being connected; to an edge of the bag delimiting the opening and the other of the first longitudinal elements connected to another edge of the bag delimiting the opening;

a slider, comprising:

two second longitudinal elements, each forming a means for guiding a sliding movement, one of the second longitudinal elements engaging one of the first longitudinal elements and slideable with respect thereto, and the other of the second longitudinal elements engaging with the other of the first longitudinal elements and slideable with respect thereto; and a central wall connecting the two second longitudinal elements of the slider to one another; and a flat base piece including an opening and comprising the two first longitudinal elements, the flat base piece accommodating the slider and being fixed to the wall of the bag so that the opening in the flat base piece coincides with the opening formed in the wall of the bag, wherein the central wall substantially covers the entire opening included in the flat base piece in the closed position.

2. The combination according to claim 1, wherein the slider further comprises at least one tab intended to be grasped by a user to move the slider.

3. The combination according to claim 2, wherein the slider further comprises a tab at two ends of the slider.

4. The combination according to claim 1, wherein the first longitudinal elements connected to the bag and the second longitudinal elements of the slider are shaped so that they engage each other by clipping them together.

5. The combination according to claim 1, wherein at least one of the first longitudinal elements connected to the bag, the slider, and the second longitudinal elements of the slider comprise means forming limit stops limiting movement of the slider in a direction for opening the bag.

6. The combination according to claim 1, wherein at least one of the first longitudinal elements connected to the bag, the slider, and the second longitudinal elements of the slider comprise means forming limit stops limiting movement of the slider in a direction for closing the bag.

7. The combination according to claim 1, wherein the slider further comprises a tab for grasping which includes a connecting portion that extends from one end of the flat base piece in one direction, and the tab for grasping extends from the one end in a different direction the connecting portion being engaged through the opening that the flat base piece delimits.

8. The combination according to claim 7, wherein the flat base piece delimits the entirety of the opening, including ends of the opening, and the regions of the flat base piece which delimit the ends of the opening, and the connecting portion, are sized to form the limit stops that limit the movement of the slider.

9. The combination according to claim 1, wherein regions of the flat base piece delimiting one end of the opening form a flap projecting towards the inside of opening.

10. The combination according claim 1, wherein a wall of the bag has a precut delimiting a strip, and the opening/closing system is fixed to an internal face of the wall under this strip.

11. The combination according claim 1, comprising:

two walls joined together at upper parts of each wall along a joining line, one of which comprises the opening of the bag formed along the joining line, and nearer to the opening, and a handle formed at the upper parts in the central region of the joining line.

12. The combination according to claim 11, wherein the walls connected to one another extend above the joining line to form a double-walled strip, and the strip comprises openings for forming the handle.

13. The combination according to claim 1, wherein the walls are made of a synthetic material that can be welded.

14. The combination according to claim 13, wherein the material is formed by bubble extrusion with a polyethylene-EVOH-polyamide-polypropylene structure, and any type of medium-, low- or high-density polyethylene and is complexed onto aluminium, polypropylene, polyester, aluminized polyester or paper.

* * * * *